US010508837B2

(12) United States Patent
Rigaud et al.

(10) Patent No.: US 10,508,837 B2
(45) Date of Patent: Dec. 17, 2019

(54) METHOD OF BRINGING TO TEMPERATURE AND HOLDING AT TEMPERATURE THE INTERIOR OF A THERMALLY INSULATED ENCLOSURE WITH NO CONTINUOUS SUPPLY OF ENERGY AND THE ASSOCIATED DEVICE

(71) Applicant: COLDWAY TECHNOLOGIES SAS, Pia (FR)

(72) Inventors: Laurent Rigaud, Pia (FR); Francis Kindbeiter, Pia (FR); David Tadiotto, Pia (FR)

(73) Assignee: COLDWAY TECHNOLOGIES SAS (FR)

( * ) Notice: Subject to any disclaimer, the term of this patent is extended or adjusted under 35 U.S.C. 154(b) by 226 days.

(21) Appl. No.: 15/516,220

(22) PCT Filed: Sep. 29, 2015

(86) PCT No.: PCT/FR2015/052600

§ 371 (c)(1),
(2) Date: Mar. 31, 2017

(87) PCT Pub. No.: WO2016/051076

PCT Pub. Date: Apr. 7, 2016

(65) Prior Publication Data

US 2017/0299234 A1 Oct. 19, 2017

(30) Foreign Application Priority Data

Oct. 1, 2014 (FR) ..... 14 59333

(51) Int. Cl.
*F25B 17/00* (2006.01)
*F25B 17/08* (2006.01)

(52) U.S. Cl.
CPC ..... *F25B 17/00* (2013.01); *F25B 17/083* (2013.01); *F25B 2315/005* (2013.01);
(Continued)

(58) Field of Classification Search
CPC .. F25B 17/00; F25B 17/083; F25B 2315/005; F25B 2315/007; F25B 2400/01; F25B 2600/2515; F25B 2700/04
See application file for complete search history.

(56) References Cited

U.S. PATENT DOCUMENTS 5,161,389 A * 11/1992 Rockenfeller ..... F25B 17/083 62/106
5,361,321 A * 11/1994 Marino ..... F24C 7/08 200/334

(Continued)

FOREIGN PATENT DOCUMENTS

WO 97/49958 A1 12/1997
WO 2005/108880 A1 11/2005

(Continued)

OTHER PUBLICATIONS

International Search Report for PCT/FR2015/052600 dated Dec. 7, 2015.

*Primary Examiner* — Henry T Crenshaw
(74) *Attorney, Agent, or Firm* — Ostrolenk Faber LLP

(57) ABSTRACT

A method for changing a temperature of the interior volume of a thermally insulated space to a preset temperature and maintaining it at the preset temperature using two thermo-chemical systems which can be connected to an external energy source. The reactor of one of the systems is heated until fully regenerated, while the other system keeps the temperature at the preset temperature; when the reactor is fully regenerated, the system comprising the regenerated reactor is used to maintain the preset temperature and the (Continued)

reactor of the other system is heated to regenerate it as long as it is connected to the external energy source.

4 Claims, 2 Drawing Sheets

(52) U.S. Cl.
CPC ..... *F25B 2315/007* (2013.01); *F25B 2400/01* (2013.01); *F25B 2600/2515* (2013.01); *F25B 2700/04* (2013.01)

(56) References Cited

U.S. PATENT DOCUMENTS 5,628,205 A * 5/1997 Rockenfeller ..... C09K 5/047 62/480
5,845,507 A * 12/1998 Critoph ..... F25B 17/083 62/106
2002/0092315 A1* 7/2002 Tanaka ..... F25B 17/086 62/480
2007/0074528 A1* 4/2007 Rodriguez ..... F25D 11/003 62/371
2008/0029250 A1* 2/2008 Carlson ..... F24F 11/0001 165/104.33
2009/0301127 A1* 12/2009 Kaufman ..... F25B 17/083 62/480
2010/0192602 A1* 8/2010 Brooks ..... B60H 1/005 62/101
2011/0252826 A1* 10/2011 Poling ..... F25B 27/02 62/476
2013/0213062 A1* 8/2013 Braunschweig ..... F25B 17/00 62/101
2013/0291574 A1* 11/2013 Athalye ..... F25B 15/00 62/101
2015/0068220 A1* 3/2015 Rigaud ..... F25B 17/083 62/4

FOREIGN PATENT DOCUMENTS

WO 2006/100412 A1 9/2006
WO 2013/164539 A1 11/2013

* cited by examiner

METHOD OF BRINGING TO TEMPERATURE AND HOLDING AT TEMPERATURE THE INTERIOR OF A THERMALLY INSULATED ENCLOSURE WITH NO CONTINUOUS SUPPLY OF ENERGY AND THE ASSOCIATED DEVICE

CROSS REFERENCE TO RELATED APPLICATIONS

This application is a National Stage of International Application No. PCT/FR2015/052600 filed Sep. 29, 2015, claiming priority based on French Patent Application No. 1459333 filed Oct. 1, 2014, the contents of all of which are incorporated herein by reference in their entirety.

BACKGROUND OF THE INVENTION

Field of the Invention

The present invention concerns a method of bringing to temperature and holding at temperature the interior of a thermally insulated enclosure with no continuous supply of energy, and a device for bringing to temperature and holding at temperature the interior of a thermally insulated enclosure capable of implementing the aforementioned method.

Description of Related Art

Certain compounds in the gaseous state can be reversibly absorbed by another compound in the liquid state. This is true of water in vapor form which can be absorbed by a solution of lithium bromide. There are also solids that are capable of reacting with gases during a reversible exothermic reaction to produce a solid product. This is the case, for example, for alkaline or alkaline-earth metal chlorides that react particularly with ammonia. There are also solid compounds such as zeolites on which a gas can be absorbed reversibly. The aforementioned absorption, adsorption and chemical reaction are exothermic and reversible; they are currently used for the production of cold and heat.

The document WO 2006/100412 A1 describes a device that comprises a thermally insulated enclosure, means of placing in circulation the air contained in the enclosure and a thermochemical system. Said thermochemical system comprises a gas reservoir capable of being placed in communication, through valve means, with a reactor; said reactor contains a solid reagent capable of reacting with the gas contained in the reservoir in order to form, during a reversible exothermic chemical reaction, a solid product. When the valve means are opened, the pressure of the gas in the reservoir decreases continuously because the gas is consumed in the reactor: the drop in pressure in the reservoir causes an absorption of heat from the ambient environment. At the same time, the chemical reaction that takes place in the reactor produces heat. The device described in the aforementioned document, thanks to the means of placing the air in circulation, makes it possible either to heat the air contained in the enclosure in contact with the reactor, or to cool it in contact with the reservoir. Said device therefore makes it possible either to heat or cool the thermally insulated enclosure, without external supply of energy, once the chemical reaction has begun. When all of the gas has reacted with the reagent, the reactor must then be reheated to induce the reverse endothermic reaction and refill the reservoir with gas. During this so-called regeneration phase, the device can no longer be used. The autonomy of the device is therefore directly related to the quantity of reagents, and particularly of the gas contained in the reservoir.

If it is desired to increase the autonomy of the aforementioned device, one solution consists of increasing the quantity of gaseous reagent. The device then becomes very cumbersome and heavy. Moreover, because the reactor is also of a large size, its regeneration phase becomes longer.

Furthermore, the document WO 2013/164539 A1 describes a device comprising two thermochemical systems that function alternately. When one of the thermochemical systems is in the regeneration phase by means of the electrical resistances that surround the reactor, the other is in the cold production phase. Means of determining the progress of the reaction make it possible to optimize the alternating of the regeneration phases. This device is not autonomous because its operation requires that one of the reactors be in the regeneration phase, which means that the device during its operation is always connected to a source of electricity. The only means of making the device mobile and autonomous is to associate a source of electricity with it that is capable of continuously supplying the electricity during its operation. Such a device proves to be expensive and cumbersome.

SUMMARY OF THE INVENTION

One purpose of the present invention is to propose a device for bringing to temperature and holding at temperature the interior of a thermally insulated enclosure that has improved autonomy compared to the device described in the document WO02006/100412 A1.

Another purpose of the present invention is to propose a device which, for the same quantity of fluid, has increased autonomy compared to the device described in the document WO2006/100412 A1.

Another purpose of the present invention is to propose a device that is capable both of producing cold and/or heat continuously and of functioning autonomously.

Another purpose of the present invention is to propose a method of producing cold and/or heat that can be implemented particularly by using the device according to the invention and which makes it possible to increase the time of utilization of said device in autonomous operation, particularly for the production of cold.

The present invention proposes a device enabling the bringing to temperature and holding at temperature of a thermally insulated enclosure, which device is capable of functioning autonomously during a given period of time. According to the invention, characteristically the device comprises: at least a first and a second system chosen independently of each other from among absorption systems, adsorption systems and thermochemical systems, said first and second systems each comprising:

- at least one reservoir containing a fluid, connected to a reactor, which contains a reagent capable of reacting exothermically and reversibly with said fluid, said reagent being consumed during said exothermic reaction and being able to be regenerated during the reverse reaction, which can be induced by heating said reactor,
- valve means for regulating the flow of said fluid between said reservoir and said reactor, and
- means of heating said reactor that are capable of inducing said inverse reaction.

Also, characteristically said heating means comprise means of temporary connection to an energy source external to said device, said temporary connection means being capable of being connected or disconnected from said external energy source; said device further comprises, means of determining the quantity of fluid present in each of said systems that has not reacted;

means of control of said valve means that are coupled to said means for determining the quantity of fluid, as well as to said heating means; and at least one thermally insulated enclosure disposed in such a way that its internal volume can be heated and/or cooled by said systems.

The presence of the second system makes it possible to consider the regeneration of the reactor of the first system during which the second system operates to produce the cold or heat. The regeneration of one of the systems potentially increases the duration of overall autonomy of the device of the invention; indeed, it is therefore possible to benefit from the presence of an external source of energy to produce the even partial regeneration of the reactors. When the device is then disconnected from said external energy source, it can again operate autonomously without the temperature in the enclosure being modified.

The presence of two systems makes it possible to increase the quantity of fluid able to react, while limiting the size of the device; the two systems can be of average size and judiciously disposed in the device.

The thermally insulated enclosure is not limited according to the invention; it can involve a thermally insulated enclosure having, for example, an overall coefficient of thermal transfer greater than or less than or substantially equal to 0.4 $W/m^2/°C$.

According to the invention, the means of determining the quantity of fluid not having reacted that is present in each of the systems are not limited; they can involve means of measuring the quantity of fluid in liquid form in the reservoir of the system, or means of measuring the pressure of the gaseous fluid in the system concerned. They can also involve means of measuring the temperature in the evaporator, or means of measuring the temperature in the condenser which indirectly provide a status of the progress of the reaction taking place in the reactor. Any means making it possible to determine directly or indirectly the quantity of fluid not having reacted can be used within the scope of the present invention.

The means of control ensure operation of the device without intervention of the user.

The means of temporary connection to an external energy source can include, for example, at least one electrical plug or any other means, when the device is supplied by an energy source, particularly electric, to enable said supply to be cut off without cutting the physical connection between the source and the device. This can involve a switch, for example. Advantageously, the means of temporary connection comprise an electrical plug, the external energy source being the electric mains.

Advantageously, said reservoir contains the fluid in liquid/vapor phase equilibrium and said device further comprises at least one evaporator connected to the outlet of the at least one of said reservoirs. It is therefore possible to produce more frigories.

Advantageously, the device comprises at least one condenser mounted between said reactor and said reservoir of at least one of said systems. The device can therefore comprise two evaporators and two condensers, one evaporator and one condenser for each of the systems.

According to one embodiment, said reservoir of each of said systems and/or said evaporator and/or said condenser is/are disposed in such a way as to enable a heat transfer with the internal volume of said thermally insulated enclosure.

The enclosure can also contain two evaporators and/or at least one of the reservoirs.

Advantageously, said reservoir of each of said systems and/or said evaporator is disposed in said thermally insulated enclosure.

Advantageously, the device comprises means of cooling the reactors of said systems. Said cooling means can be fans for example, or any other means of cooling capable of functioning autonomously.

The device of the invention can form an integral part of a vehicle. Thus, the thermally insulated enclosure can make up an integral part of the trunk of a vehicle or be contained in the trunk of the vehicle. The temporary means of connection then comprise an electrical plug capable of being connected to the electric mains and/or to the battery of the vehicle.

According to another embodiment that can be combined with the preceding one, when the vehicle is at rest, the heating means are designed to use the electric energy from the battery of the vehicle to regenerate at least one of the reactors. In this case, the vehicle also has means for detecting the status of the charge of the vehicle's battery. It is possible, within the scope of the present invention, to use any available source of energy in the vehicle when underway or when stopped to regenerate the reactors. Thus, for example, the heat can be used from the exhaust gases, or the heat released during braking to regenerate the reactors.

The present invention also relates to a method of producing cold and/or heat in a thermally insulated enclosure, capable of being implemented in a device enabling the bringing to temperature and holding at temperature of a thermally insulated enclosure, said device comprising:

at least a first and a second system chosen independently of each other from among absorption systems, adsorption systems and thermochemical systems, said first and second systems each comprising:

at least one reservoir containing a fluid, connected to a reactor which contains a reagent capable of reacting exothermically and reversibly with said fluid, said reagent being consumed during said exothermic reaction and being able to be regenerated during the reverse reaction, which can be induced by heating said reactor, valve means to regulate the flow of said fluid between said reservoir and said reactor, and means of heating said reactor capable of regenerating said reactor by bringing about said reverse reaction; said heating means being capable of being connected to an energy source external to said device and able to be disconnected from said external energy source;

said device further comprising, means of determining the quantity of fluid present in each of said systems that has not reacted;

means of controlling said valve means that are coupled to said means of determining the quantity of fluid, and which are coupled to the means of heating each of said systems; and at least one thermally insulated enclosure disposed in such a way that its internal volume can be heated and/or cooled by said systems;

According to the method of the invention, it is arranged that all of the fluid of each of said systems is contained in said reservoir of said system;

at least one of said systems is used to bring the temperature of the internal volume of said enclosure to a given preset temperature;

if this has not already been done, said heating means are connected to said external source of energy;

a) the reactor of one of said systems is heated until complete regeneration, while the other system maintains the temperature of the internal volume of said enclosure at said setpoint temperature;

b) when the reactor is completely regenerated, the system having the reactor that has just been regenerated is used to maintain the temperature of the internal volume of said enclosure at said setpoint temperature before all the reagent and/or all the fluid of the other system is consumed in said exothermic reaction, and the reactor of the other system, which still contains reagent and said fluid capable of reacting, is heated until its complete regeneration;

while said connection means are connected to said external source of energy, the aforementioned steps a) and b) are repeated;

when said heating means are disconnected from said external source of energy, each of said systems is used successively to maintain the temperature of the internal volume of said enclosure at said setpoint temperature.

The Applicant has revealed that the implementation of steps a) and b) above make it possible to increase the autonomy of the aforementioned device, irrespective of the moment when the connection means are disconnected from the external energy source.

The disconnection of the connection means can be voluntary and implemented by the user, but can also involve an involuntary or accidental disconnection, such as a power failure.

This method can be used to cool and/or heat the interior of the thermally insulated enclosure. It can be implemented when the setpoint temperature is higher than the ambient temperature or when the setpoint temperature is lower than the ambient temperature.

Advantageously, the setpoint temperature is lower or higher than the ambient temperature throughout the implementation of the method of the invention.

The Applicant has revealed that the aforementioned method made it possible to increase the duration of autonomy of the device of the invention.

Indeed, the Applicant's distinction is having revealed that the regeneration of a reactor would produce a thermal transfer to the thermally insulated enclosure and that it was then necessary to increase the flow of fluid entering into the reactor of the system in operation in order to compensate for the aforementioned thermal transfer. The Applicant has also verified that the bringing the enclosure to temperature requires more energy than holding it at temperature, and that the energy expended (and thus the quantity of fluid that can react) to counteract the thermal transfer due to the reactor in the process of regeneration was minimal when the steps a) and b) above were implemented at least once. The repetition of the steps a) and b) enables the autonomy of the aforementioned device to be increased still more.

Advantageously, said valve means of each of the systems are kept closed for a given period of time after having caused said given quantity of fluid to penetrate into the at least one of said reactors. Said period of time during which the systems are at rest makes it possible to achieve thermal equilibrium in the thermally insulated enclosure of the device of the invention, and to economize on the fluid. Said period of time depends on the insulation of the thermal enclosure.

Advantageously, if the two systems are used to bring the internal volume of said enclosure to said setpoint temperature, the quantity is determined of fluid not having yet reacted in each of said systems, and the reactor is heated of the system that contains the smallest quantity of fluid not having reacted.

According to one implementation, the reactor is used in which the reagent has just been regenerated in order to maintain the temperature of the internal volume of the enclosure at said setpoint temperature before the temperature of said reactor reaches the temperature of the ambient environment at said enclosure. For example, the system can be used when the temperature of the reactor is substantially equal to 70° C.

Indeed, the Applicant has shown that the temperature of the reactor and therefore the pressure therein had no influence on the production of heat and/or cold in the enclosure. It is therefore also possible to shorten the period during which the system is not used (because of its regeneration and its excessive temperature caused by the regeneration) by quickly using the regenerated reactor, without waiting for it to reach ambient temperature. Because the period of nonuse of the system in regeneration is reduced still more, the consumption of fluid in the other system is therefore also reduced.

Advantageously, for each of the systems, the reservoir contains at least the quantity of fluid capable of reacting with all of the reagent contained in the reactor. Advantageously, it contains substantially the quantity of fluid necessary for consumption, during the exothermic reaction, of all the reagent contained in the reactor.

Definitions

Within the meaning of the present invention, an absorption system is a system that comprises a liquid in which a gas is absorbed, without change of volume.

Within the meaning of the present invention, an adsorption system is a system that comprises a solid at the surface of which the molecules of a gas can be attached without creating a covalent bond, but by simple interactions of the van der Waals type for example. A system comprising zeolites is an example of an adsorption system.

The term "thermochemical system" within the meaning of the present invention designates a system in which a fluid (gas or liquid) reacts with a reagent, advantageously solid, to form a new solid or liquid product, with creation of covalent bonds. The reagent can be in liquid, gas or solid form. One example of such a system is ammonia in the form of gas which reacts with manganese chloride, or barium chloride.

For reasons of simplicity throughout the present application, the term "react" will be used irrespective of whether it involves a thermochemical system or an adsorption or absorption system. Similarly, the term "reaction" is used both for a true chemical reaction as well as for an adsorption or an absorption.

The term "regeneration" and the affiliated terms such as "regenerated" designate, when applied to a reactor, the desorption of the adsorbed or absorbed product, depending on the situation, or the decomposition of the product obtained during the exothermic reaction between the reagent and the fluid. The decomposition of said reaction product makes it possible to obtain directly or not the fluid, which can then react again with the regenerated reagent. The term "regenerated reactor" indicates that the product of the exothermic reaction has been totally decomposed and that all the fluid and the reagent of the reactor are again usable.

The term "reverse reaction" designates either the desorption of the gas adsorbed on a solid, or the changeover of the absorbed gas into a liquid in gaseous form, or the thermal decomposition reaction of the product of the chemical reaction between the reagent and the gas. In every case, said reaction is endothermic.

The term "autonomy" means that the device produces cold and/or heat with no external supply of energy for a given period of time, in particular with no supply of energy to regenerate one of the reactors by heating. Autonomous operation means that the device according to the invention can be moved during its operation and that it does not need to be connected to an external energy source during its operation, particularly to a source of electricity.

Ambient temperature refers to the temperature of the environment outside the thermally insulated enclosure and the device in general.

The present invention, its characteristics and various advantages will be better understood from the following description of an embodiment of the device of the invention and of an example of implementation of the method of the invention, with reference to the appended figures in which:

DESCRIPTION OF THE PREFERRED EMBODIMENT

Figure 1:
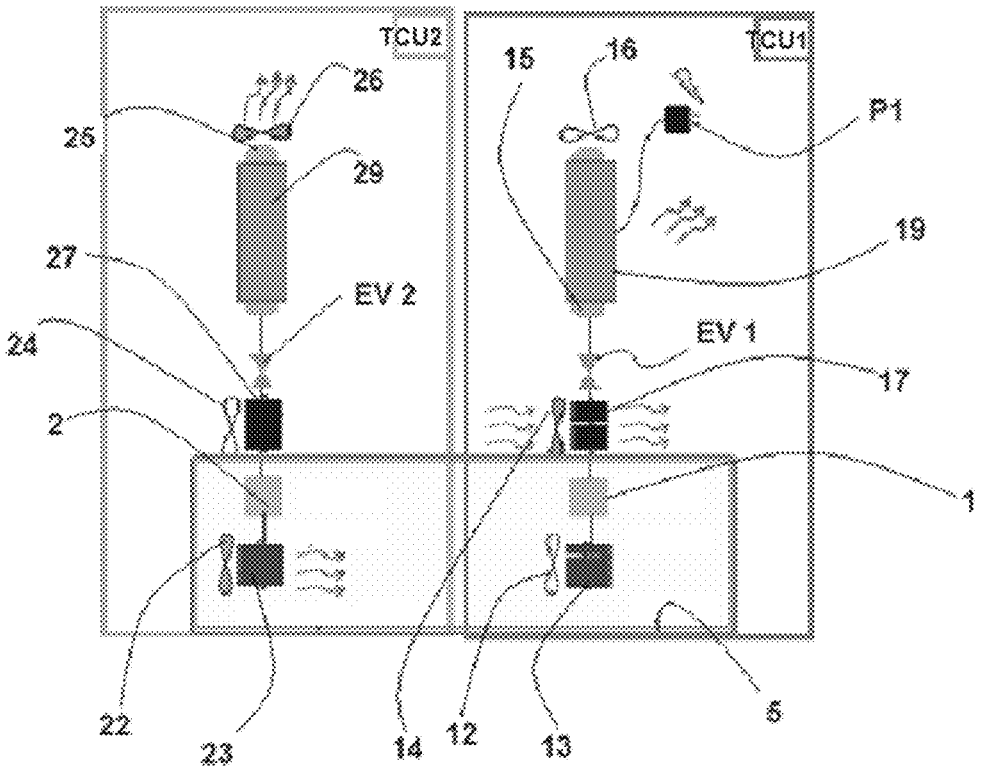
FIG. 1 represents an embodiment of the device according to the invention, the thermally insulated enclosure being disposed in such a way that its internal volume is cooled to a setpoint temperature and then held at that temperature.

With reference to FIG. 1, a particular embodiment of the present invention will now be described. According to the embodiment represented, the device of the invention comprises two thermochemical systems TCU1 and TCU2 and a thermally insulated enclosure 5 the internal volume of which is intended to be cooled to a setpoint temperature Tc, then held at said temperature. The first thermochemical system TCU1 comprises a reservoir 1 connected to an evaporator 13 disposed inside the thermally insulated enclosure 5. The reservoir 1 is also connected to the reactor 15, disposed opposite the evaporator 13. A condenser 17 is mounted between the reactor 15 and the reservoir 1. A solenoid valve EV1 is mounted between the condenser 17 and the reactor 15. Fans 12, 14 and 16 enable the heat transfer to be accelerated at the evaporator 13, the condenser 17 and the reactor 15. The second thermochemical system TCU2 has the same structure as the first and comprises a reservoir 2 connected to an evaporator 23. The reservoir 2 is also connected to the reactor 25, disposed opposite the evaporator 23. A condenser 27 is mounted between the reactor 25 and the reservoir 2. A solenoid valve EV2 is mounted between the condenser 27 and the reactor 25. Fans 22, 24 and 26 enable the heat transfer to be accelerated at the evaporator 23, the condenser 27 and the reactor 25. The reactor 15 comprises heating means 19 which are electric and capable of being connected to a source of electricity by means of the plug P1. The reactor 25 also comprises electrical heating means 29 which are capable of being connected to a source of electricity by means of a plug, not shown. According to one variant, a switch enables power to be supplied alternatively to the heating means 19 and 29.

The systems TCU1 and TCU2 are thermally insulated from each other. However, the reactors 15 and 25 and/or the condensers 17 and 27 can be thermally connected with the interior of the enclosure 5. They can therefore potentially heat said enclosure when the setpoint temperature is higher than the ambient temperature.

As represented in FIG. 1, the reactor 15 is in the process of regeneration while the second system TCU2 produces frigories at its reservoir 2 and its evaporator 23 in order to cool the enclosure 5. In the present case, the setpoint temperature is always lower than the ambient temperature and the enclosure 5 should be cooled.

In the embodiment represented in FIG. 1, the evaporators 13 and 23 and the reservoirs 1 and 2 are situated in the thermally insulated enclosure 5, while the rest of the elements of the two thermochemical systems TCU1 and TCU2 are situated in a box outside the enclosure 5. For purposes of clarity, the control means as well as the means of determining the progress of the reaction are not represented in FIG. 1.

One mode of operation of the device of the invention will now be explained with reference to FIG. 1.

At t=0, the internal temperature of the enclosure 5 is substantially equal to 25° C., which is the ambient temperature. The ambient temperature does not vary throughout the implementation of the method. The two reservoirs 1 and 2 are filled with liquid ammonia in equilibrium with ammonia gas. To cool the enclosure 5, the solenoid valve EV1 of the first system TCU1 is opened, thus causing the gas to enter from the reservoir 1 to the reactor 15. The gas is consumed during its exothermic reaction with the solid reagent contained in the reactor 15. The evaporation of the liquid in the evaporator 13 generates an absorption of heat inside the enclosure 5, thus cooling it. A certain quantity of fluid is consumed to bring the temperature of the enclosure 5 to the setpoint temperature Tc.

When the setpoint temperature Tc is reached, the plug P1 is connected to the mains to regenerate the reactor 15 of the system TCU1. This configuration is represented in FIG. 1.

The second system TCU2, which still contains fluid and reagent capable of reacting, is then used to hold the temperature in the enclosure 5 at the setpoint value Tc. The solenoid valve EV2 is then opened. While the second system TCU2 cools the enclosure 5, the regeneration by heating the reactor 15 produces calories which should compensate for the cooling of the second system TCU2. The quantity of liquid ammonia present in the reservoir 1 is measured in the first system TCU1 as a function of time. When the level of liquid ammonia returns to the same value as at t=0, the heating of the reactor 15 is stopped, which is thus fully regenerated, and the reactor 25 is heated. The reactor 15 is therefore fully regenerated and is quickly used to maintain the enclosure 5 at the setpoint temperature.

The aforementioned steps are repeated as long as it is possible to connect the heating means 19 and 29 to the mains.

At t=t1, the heating means 19 and 29 are disconnected from the mains and the systems TCU1 and TCU2 are used to maintain the temperature of the enclosure 5 at the value Tc until all of the reagent of the reactor has reacted or all of the fluid has reacted, depending on how the quantity of fluid or reagent limits the exothermic reaction. A switchover is then made to the second system which is used to maintain temperature. As will be explained later, the aforementioned steps make it possible to optimize the quantity of fluid not having reacted in both of the systems TCU1 and TCU2.

EXAMPLE

Cooling of a Thermally Insulated Enclosure to a Setpoint Temperature

A device according to FIG. 1 is prepared to cool a thermally insulated enclosure having an internal volume of 75 L. The overall heat transfer coefficient of the enclosure is evaluated at 0.362 $W/m^2/°$ C. The setpoint temperature in the enclosure is 2° C. Two identical thermochemical systems are used, each comprising a reservoir 88.9 mm in diameter and 504 mm long and comprising a wall 3 mm thick. Each system comprises an evaporator of the same dimensions as the reservoir. Each system contains 1.3 kg ammonia (or 75 moles) capable of reversibly reacting with a block formed by compaction of a mixture of expanded natural graphite and manganese chloride in powder form. Each system comprises a reactor 114.3 mm in diameter, 680 mm long and having a wall 3 mm thick. Each reactor is surrounded by two heating elements each providing power of 266 W. Fans are used to cool the reactors of the systems. The device also comprises an electric battery to supply the fans when the device functions in autonomous mode, as well as to supply the solenoid valves.

At the end of regeneration, the reactors are cooled to return them to a lower temperature, which is either the ambient temperature or a temperature above ambient temperature but which allows the use of the system for producing heat and/or cold. The reactors are also cooled during their use for producing heat and/or cold, whether the device is functioning in autonomous mode or is connected to an external source of energy (the mains). The cooling of the reactors makes it possible to have a lower temperature on the evaporators. The fans can therefore be supplied with 12 V by the battery mounted in the device and capable of being supplied through a transformer connected to the mains.

The reversible exothermic chemical reaction taking place in the reactors is as follows:

$$(MnCl_2.2.NH_3)+4NH_3 \longleftrightarrow MnCl_2,6.NH_3 \text{ (47 kJ/mole}NH_3\text{)}$$

The temperatures and pressures in the various elements of the system are measured while it is in operation to verify that they correspond properly to the values calculated with the Clapeyron diagram.

In the step during which the exothermic reaction takes place in the reactor, for a setpoint temperature equal to 2° C., an ambient temperature substantially constant and equal to 25° C., the maximum temperature in the reactor is 80° C., which is reached at the beginning of reaction and the minimum temperature is 60° C. at the end of reaction. During the exothermic reaction, the temperature in the reactor is substantially stable and equal to 70° C. When the reaction is ended, the temperature in the reactor decreases. The pressure in the system drops then remains constant when the setpoint temperature is reached, due to the adjustment of the flow of ammonia entering the reactor. All ammonia entering is consumed in the exothermic reaction. When the setpoint temperature is reached, the pressure P1 is 2.2 bar. An increase in pressure in the system indicates that the ammonia is no longer being consumed in the reactor and that the exothermic reaction is ended. The temperature in the evaporator is substantially equal to minus 20° C. when the valve means are opened. The temperature increases slightly to stabilize at minus 15° C. during the exothermic reaction, once the setpoint temperature is reached. The increase in temperature in the evaporator indicates the end of the exothermic reaction. The temperature and pressure values are given by the Clapeyron equation diagrams.

Operation with a Single System

If a single thermochemical system is used, a temperature of 2° C. in the enclosure can be reached in 30 minutes (the initial temperature in the enclosure being 25° C.). Said drop in temperature consumes 68.8% of the ammonia of the reservoir. The temperature can then be maintained at 2° C. for 23 hours, which corresponds to an autonomous operation of 23.5 hours.

Operation with Two Systems in Phase Opposition

Figure 2A:
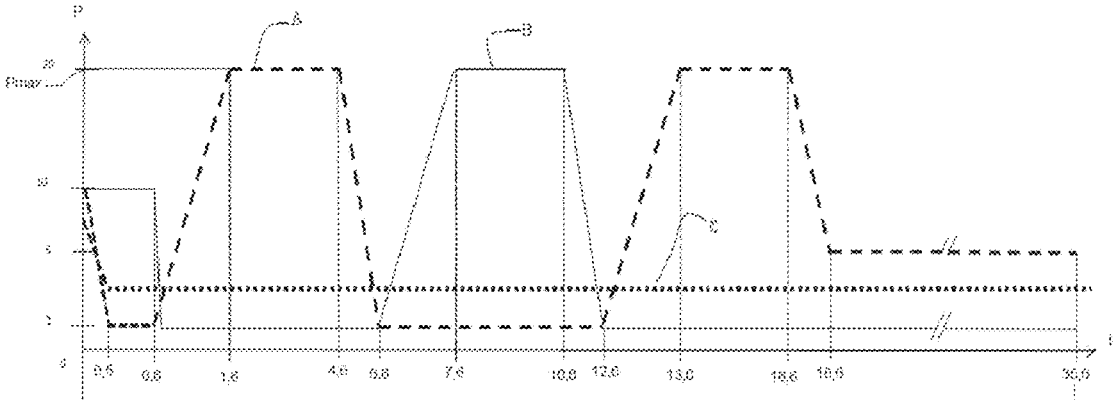
FIG. 2*a* represents an operational diagram of the device represented in FIG. 1 according to a method called "in phase opposition;" the curves represent, for each of the systems, the change in pressure in the system concerned as a function of time, and the change of temperature in the enclosure as a function of time.

FIG. 2*a* represents an operational diagram of the aforementioned device, the two systems being in phase opposition, that is, one reactor is fully regenerated (i.e., until the maximum pressure of ammonia in the system is obtained), then it is cooled to ambient temperature before using it completely to maintain the enclosure 5 at temperature; the reactor of the other system is completely regenerated during the period of use of the first system. The duration of nonuse of the system in process of regeneration corresponds to the duration of regeneration plus the duration of cooling to ambient temperature.

The curve A represents the variations in pressure P in the first thermochemical system as a function of time. The curve B represents the variations in pressure in the second thermochemical system. The curve C represents the variations of the temperature in the thermally insulated enclosure 5, the setpoint temperature being equal to 2° C. The two reservoirs 1 and 2 are filled before beginning to cool the enclosure 5. Each of the regeneration phases lasts six hours, including the increase in temperature of the reactor concerned and the decrease of its temperature down to ambient temperature after regeneration and prior to its use for cooling the enclosure. At t=18.6 hrs, the heating means of the reactors are disconnected from the mains.

It can be seen in FIG. 2*a* that the setpoint temperature can be preserved even when a reactor is being regenerated. It will also be noted that the device can function autonomously, i.e. without regeneration of the reactors.

The following Tables I and II show the results concerning the consumption and regeneration of gaseous ammonia in the systems of the device as a whole at the different times indicated in FIG. 2*a*. The number shown in each case indicates, at the instant t concerned, the percentage of ammonia gas contained in the system and therefore available for generating the heat and/or cold. At t=0 the cooling of the enclosure 5 is begun by opening the valve EV1. A switchover is then made from one totally used system to the other in order to maintain the setpoint temperature at 2° C. The reactors are heated to regenerate them only when the quantity of reagent they contain has been totally consumed in the exothermic reaction.

TABLE I

| | Time (h) | | | | | | |
|---|---|---|---|---|---|---|---|
| | 0 | 0.5 | 0.6 | 1.6 | 4.6 | 6.6 | 7.6 |
| System 1 | 100 | 68.8 | 68.5 | 68.5 | 100 | 100 | 100 |
| System 2 | 100 | 100 | 100 | 100 | 75.9 | 56.7 | 56.7 |

TABLE I-continued

| | Time (h) | | | | | | |
|---|---|---|---|---|---|---|---|
| | 0 | 0.5 | 0.6 | 1.6 | 4.6 | 6.6 | 7.6 |
| Total | 200 | 168.8 | 168.5 | 168.5 | 175.9 | 156.7 | 156.7 |

TABLE II

| | Time (h) | | | | | |
|---|---|---|---|---|---|---|
| | 10.6 | 12.6 | 13.6 | 16.6 | 18.6 | 35.6 |
| Reservoir 1 | 75.9 | 56.7 | 56.7 | 100 | 100 | 100 |
| Reservoir 2 | 100 | 100 | 100 | 75.9 | 56.7 | 0 |
| Total | 175.9 | 156.7 | 156.7 | 175.9 | 156.7 | 100 |

It will be noted from the above results that with two systems in opposition cold can be produced continuously for as long as the heating means of the reactors are supplied with electricity. If the device is disconnected from said external source of energy, after the enclosure has been brought to temperature and after at least one regeneration of the first system used to bring it to temperature, the device contains at least 156.7% of gaseous ammonia still usable in autonomous mode, which corresponds to 50 hours of autonomous refrigeration.

Operation according to the Method of the Invention

Figure 2B:
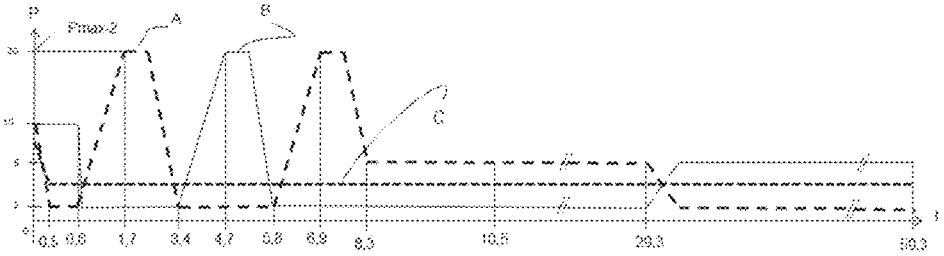
FIG. 2*b* represents an operational diagram of the device represented in FIG. 1 according to the method of the invention, the curves represent, for each of the systems, the change in pressure in the system concerned as a function of time, and the change of temperature inside the enclosure as a function of time.

FIG. 2*b* represents an operational diagram according to the method of the invention. The curves A to C represent the same elements as those explained with reference to FIG. 2*a*. As was previously explained, the regenerated reactor is used for cooling the enclosure before its temperature reaches ambient temperature. In the present case, the regenerated reactor is cooled to a temperature substantially equal to 70° C. before being used to cool the enclosure 5 via its evaporator and reservoir. The regeneration of the reactor of the system being used to maintain the temperature of the enclosure at the setpoint value is initiated as soon as the reactor of the other system is totally regenerated, and advantageously before its temperature reaches ambient temperature.

In the following example, a quantity of ammonia is determined that is available for reacting in the reactor by measuring the pressure in the system concerned. It is known that when the pressure is maximal, the reactor is totally regenerated. The stopping of the regeneration phase of the reactor is triggered when the pressure in the system that includes the reactor concerned is substantially equal to Pmax. The regeneration phases last from 2.4 to 2.8 hours each depending on the quantity of reagent to be regenerated. The regeneration phases become shorter and shorter when the steps a and b are repeated.

Tables III and IV below assemble the results obtained from a model of operation of the aforementioned device with the mode of operation according to the invention. The numbers also indicate the percentage of gaseous ammonia, as explained with reference to Tables I and II.

TABLE III

| | Time (h) | | | | | | |
|---|---|---|---|---|---|---|---|
| | 0 | 0.5 | 0.6 | 1.7 | 3.4 | 4.7 | 5.8 |
| System 1 | 100 | 68.8 | 68.5 | 68.8 | 100 | 100 | 87.7 |
| System 2 | 100 | 100 | 100 | 100 | 87.7 | 87.7 | 100 |

TABLE III-continued

| | Time (h) | | | | | | |
|---|---|---|---|---|---|---|---|
| | 0 | 0.5 | 0.6 | 1.7 | 3.4 | 4.7 | 5.8 |
| Total | 200 | 168.8 | 168.5 | 164.3 | 187.7 | 187.7 | 187.7 |

TABLE IV

| | Time (h) | | | | |
|---|---|---|---|---|---|
| | 6.9 | 8.3 | 10.5 | 29.3 | 59.3 |
| Reservoir 1 | 87.7 | 100 | 100 | 100 | 0 |
| Reservoir 2 | 100 | 87.7 | 43.9 | 0 | 0 |
| Total | 187.7 | 187.7 | 143.9 | 100 | 06 |

At t=8.3 hrs, the heating means are disconnected from the mains and the autonomous operation begins. In view of the aforementioned results, shown in Tables III and IV above, it will be seen that after having achieved a regeneration of the reactor of the first system that was used to bring the interior of the enclosure to the setpoint temperature, the device contains a minimum of 187.7% ammonia in the form of gas at any time. Thus, if the device is disconnected from the mains after said regeneration phase, an autonomy of 59.3 hours is achieved. The autonomy is therefore increased compared to the "in opposition" operation explained previously.

The invention claimed is:

1. A method of changing a temperature of an internal volume of a thermally insulated enclosure to a preset temperature and maintaining said temperature at said preset temperature, wherein:

a device is provided comprising:

at least a first and a second system chosen independently of each other from among absorption systems, adsorption systems and thermochemical systems, said first and second systems each comprising:

at least one reservoir containing a fluid, connected to a reactor which contains a reagent capable of reacting exothermically and reversibly with said fluid, said reagent being consumed during said exothermic reaction and being able to be regenerated during the reverse reaction, which can be induced by heating said reactor, and a heater for heating said reactor and capable of regenerating said reagent by inducing said reverse reaction; said heater being capable of being connected to an energy source external to said device and able to be disconnected from said external energy source;

wherein said device further comprises:

at least one thermally insulated enclosure disposed in such a way that its internal volume can be heated and/or cooled by said first and second systems;

wherein all of the fluid of each of said systems is contained in said reservoir of said system before the method is performed;

the method comprising:

using at least said first system of said systems to change said temperature of the internal volume of said enclosure to said preset temperature by said exothermic reaction;

connecting said heater of said first system to said external energy source when said preset temperature is reached;

a) heating the reactor of said first system of said systems until complete regeneration of said reagent, while said second system maintains said temperature of the internal volume of said enclosure at said preset temperature by said exothermic reaction;

b) when the reagent is completely regenerated, said heater of said first system is disconnected from said external energy source, and said first system having the reactor whose reagent has just been regenerated is used to maintain said temperature of the internal volume of said enclosure at said preset temperature before all the reagent and/or all the fluid of said second system is consumed in said exothermic reaction, and the reactor of said second system, which still contains reagent and said fluid capable of reacting, is heated by connecting said heater of said second system to said external energy source until the complete regeneration of the reagent, at which time said heater of said second system is disconnected from said external energy source;

c) connecting said heater of said first system to said external energy source; and d) returning to step a);

while said heaters of said first system and said second system are connected to said external energy source, the aforementioned steps a), b), c), and d) are repeated; when each of said heaters of said first and second systems is disconnected from said external energy source, each of said first and second systems is used successively to maintain said temperature of the internal volume of said enclosure at said preset temperature.

2. The method according to claim 1, wherein when said first and second systems are used to change said temperature of the internal volume of said enclosure to said preset temperature, the quantity of unreacted fluid is determined in each of said first and second systems, and the reactor of the system that contains the smallest quantity of unreacted fluid is heated.

3. The method according to claim 1, wherein said reactors of each of said first and second systems are kept isolated from said reservoirs for a given period of time after a beginning of said exothermic reaction.

4. The method according to claim 1, wherein the reactor in which the reagent has just been regenerated is used in order to maintain said temperature of the internal volume of the enclosure at said preset temperature before a temperature of said reactor reaches a temperature of the environment external to said enclosure.

* * * * *